US007179412B1

(12) United States Patent
Wilkie et al.

(10) Patent No.: US 7,179,412 B1
(45) Date of Patent: Feb. 20, 2007

(54) METHOD AND APPARATUS FOR PRODUCING POLYMER FIBERS AND FABRICS INCLUDING MULTIPLE POLYMER COMPONENTS IN A CLOSED SYSTEM

(75) Inventors: Arnold Wilkie, Merritt Island, FL (US); Hermann Balk, Troisdorf (DE)

(73) Assignees: Hills, Inc., West Melbourne, FL (US); Reifenhauser GmbH & Co. Maschinenfabrik, Troisdorf (DE)

( * ) Notice: Subject to any disclaimer, the term of this patent is extended or adjusted under 35 U.S.C. 154(b) by 134 days.

(21) Appl. No.: 10/043,288

(22) Filed: Jan. 14, 2002

Related U.S. Application Data

(60) Provisional application No. 60/260,868, filed on Jan. 12, 2001.

(51) Int. Cl.
*D01D 5/30* (2006.01)
*D01D 5/08* (2006.01)
*D01F 6/00* (2006.01)
*D01F 8/04* (2006.01)

(52) U.S. Cl. ..... 264/172.11; 264/171.1; 264/172.17; 264/172.19; 264/DIG. 26; 264/DIG. 29

(58) Field of Classification Search ..... 264/172.11, 264/172.12, 172.13, 172.14, 172.15, 172.17, 264/172.18, 555, DIG. 26, DIG. 29; 425/72.2, 425/131.5
See application file for complete search history.

(56) References Cited

U.S. PATENT DOCUMENTS 3,197,813 A * 8/1965 Le Grand ..... 432/219
3,209,402 A * 10/1965 Riley et al. ..... 425/131.5
3,562,858 A * 2/1971 Lehner ..... 425/192 R
3,659,989 A * 5/1972 Uraya et al. ..... 425/131.5
3,817,672 A * 6/1974 Lenk ..... 425/73
4,648,826 A * 3/1987 Ogasawara et al. ..... 425/192 S
4,698,008 A * 10/1987 Lenk et al. ..... 425/192 S
5,162,074 A 11/1992 Hills
5,411,693 A * 5/1995 Wust, Jr. ..... 264/172.15
5,460,500 A 10/1995 Geus et al.
5,466,410 A * 11/1995 Hills ..... 264/172.11
5,503,784 A 4/1996 Balk
5,571,537 A 11/1996 Geus et al.
5,595,699 A * 1/1997 Wright et al. ..... 264/169
5,700,491 A * 12/1997 Herwegh et al. ..... 425/72.2
5,766,646 A 6/1998 Geus et al.
5,800,840 A 9/1998 Geus et al.
5,814,349 A 9/1998 Geus et al.
5,820,888 A 10/1998 Geus et al.
5,866,050 A * 2/1999 Krauss et al. ..... 264/40.6
6,103,181 A * 8/2000 Berger ..... 264/555
6,120,276 A * 9/2000 Balk ..... 425/131.5
6,164,950 A * 12/2000 Barbier et al. ..... 425/378.2
6,241,503 B1 * 6/2001 Wright et al. ..... 425/131.5
6,478,563 B1 * 11/2002 Allen ..... 425/131.5
6,737,009 B2 * 5/2004 Taylor et al. ..... 264/555
2002/0063364 A1 * 5/2002 Taylor et al. ..... 264/555
2002/0094352 A1 * 7/2002 Guo ..... 425/131.5

FOREIGN PATENT DOCUMENTS

DE 63116 * 8/1968

(Continued)

*Primary Examiner*—Melvin Mayes
(74) *Attorney, Agent, or Firm*—Edell, Shapiro & Finnan, LLC

(57) ABSTRACT

A closed fiber spinning system includes a spin beam assembly including a plurality of polymer distribution manifolds to independently deliver different polymer component fluid streams to a spin pack and independently maintain those fluid streams at different temperatures. The spin beam assembly in combination with the closed spinning system facilitates the production of a wide variety of multiple polymer component fiber and fabric products having a desired denier and degree of uniformity.

7 Claims, 6 Drawing Sheets

FOREIGN PATENT DOCUMENTS

| | | | |
|---|---|---|---|
| DE | 63117 | * | 8/1968 |
| DE | 100 01 521 | * | 9/2000 |
| DE | 101 43 070 | * | 5/2002 |
| JP | 55-90612 | * | 7/1980 |
| JP | 61-296110 | * | 12/1986 |
| JP | 62-78206 | * | 4/1987 |
| WO | 99/48668 | * | 9/1999 |
| WO | WO 02/12604 | | 2/2002 |

* cited by examiner

METHOD AND APPARATUS FOR PRODUCING POLYMER FIBERS AND FABRICS INCLUDING MULTIPLE POLYMER COMPONENTS IN A CLOSED SYSTEM

CROSS REFERENCE TO RELATED APPLICATION

This application claims priority from U.S. Provisional Patent Application Ser. No. 60/260,868, entitled "Method, Apparatus, and Fabrics Produced via a Non-Woven Multi-Component Spun Thermoplastic Filament Process," filed Jan. 12, 2001. The disclosure of this provisional patent application is incorporated herein by reference in its entirety.

BACKGROUND OF THE INVENTION

1. Field of the Invention

The present invention relates to methods and apparatus for producing fibers and fabrics in a closed fiber spinning system, where the fibers and fabrics include a plurality of different polymer components.

2. Description of the Related Art

A number of closed fiber spinning systems are known in the art for manufacturing spunbond fabrics having certain desirable characteristics. For example, U.S. Pat. Nos. 5,460,500, 5,503,784, 5,571,537, 5,766,646, 5,800,840, 5,814,349 and 5,820,888 all describe closed systems for producing spunbond webs of fibers. The disclosures of these patents are incorporated herein by reference in their entireties. In a typical closed system, filaments are spun, quenched and drawn in a common enclosed chamber or environment, such that the air or gas stream that is utilized to quench the fibers emerging from a spinneret is also utilized to draw and attenuate the fibers downstream from the quenching stage.

In direct contrast to open fiber spinning systems (i.e., systems in which extruded filaments are not spun, quenched and drawn in a common chamber or environment and are typically exposed to the ambient environment during some or all of the fiber forming steps), closed systems eliminate any interference from uncontrolled and potentially detrimental air currents during fiber formation. In fact, a typical closed fiber spinning system limits exposure of extruded filaments to only desirable air or gas currents having selected temperatures during fiber formation, thus facilitating the production of very delicate and uniform fibers having desirable deniers that are difficult to obtain from a typical open fiber spinning system.

One important component in any fiber spinning system is the polymer delivery system, typically referred to as the spin beam, which provides molten polymer streams at a selected metering or flow rate to the fiber spinning system for extrusion into filaments by a spinneret. One type of spin beam typically utilized and highly advantageous for spinning fibers in a closed system is commonly referred to as a "coat hanger" spin beam. This type of spin beam is typically formed by two sections, constructed of metal or other suitable material, joined together in a fluid tight relationship at facing or mating surfaces, where each mating surface has grooves etched into the surface that correspond with and mirror grooves etched in the mating surface of the other section. The grooves etched on each mating surface form a profile that resembles a triangular "coat hanger" configuration.

An exploded view of a conventional "coat hanger" spin beam is illustrated in FIG. 1. Spin beam 2 includes two generally rectangular halves or sections 3 having a number of electric heaters 12 disposed within each section to heat polymer fluid flowing within the spin beam toward the spinneret. In operation, a molten polymer stream is directed (e.g., via a pump) into an inlet portion 4 of the "coat hanger" channel profile of spin beam 2 and travels into an upper portion of the triangular channel portion 6 of the "coat hanger" profile that is disposed below and in fluid communication with inlet portion 4. The "coat hanger" channel defined by the inlet portion and the triangular portion is formed by corresponding grooves disposed on the mating surfaces of the two spin beam sections 3. Upon entering channel 6, the molten polymer stream splits into the two diverging channel sections 7 of the triangular channel portion, where the split streams continue to travel and then converge within a horizontal channel section 8 disposed at a lower end of the "coat hanger" channel between the lower ends of the diverging channel sections. The horizontal channel section also extends longitudinally along a lower end of spin beam 2. Affixed at the lower end of the spin beam are a screen filter and plate 9 and a spinneret 10 having a plurality of orifices disposed along its longitudinal dimension. The screen filter, plate and spinneret also extend longitudinally along the lower end of spin beam 2 and are aligned and in fluid communication with horizontal channel section 8. Thus, the molten polymer stream traveling into horizontal channel section 8 of the "coat hanger" channel proceeds to flow through screen filter and support plate 9 to spinneret 10, where the polymer stream is then extruded through the spinneret orifices to form a plurality of polymer filaments. The "coat hanger" channel configuration is particularly advantageous because it is simple in design and creates a substantially uniform pressure differential within the channels, resulting in a uniform delivery of the polymer stream into the horizontal channel portion of the "coat hanger" channel and uniform extrusion of molten polymer through the spinneret orifices.

While a closed fiber spinning system combined with a "coat hanger" spin beam is useful for manufacturing certain polymer fibers having desirable uniformities and deniers, the "coat hanger" spin beam encounters problems when two or more different polymer components are utilized to produce more complex fibers and spunbond webs of fibers. In particular, it is very difficult in a "coat hanger" closed system to process two or more different polymer components having different melting temperatures when manufacturing multicomponent fibers or fabrics containing multiple polymer components. For example, a bicomponent fiber consisting of two polymer components with significantly different melting points would be extremely difficult to produce utilizing a closed spinning system with a "coat hanger" spin beam (e.g., by utilizing a double "coat hanger" spin beam with "coat hanger" channels being arranged in a side-by-side manner), because the "coat hanger" spin beam would tend to be maintained at substantially the same temperature by the electrical heaters disposed in the spin beam sections. The difficulty is further exacerbated when utilizing polymer components that must be maintained at or very near their melting temperatures to avoid gelling or cross-linking of the polymers. Moreover, while the "coat hanger" systems deliver a uniform molten polymer stream to the spinneret, it is difficult to modify the metering of the molten polymer stream through the "coat hanger" spin beam to the spin pack, which is an important feature in manufacturing more complex types of fibers such as multicomponent fibers having varying geometries and/or polymer component cross-sections. Thus, the flexibility of "coat hanger" spin beams is very limited in enabling the manufacture of a wide variety of different fibers and fabrics within a closed fiber spinning system.

Accordingly, there exists a need for producing a wide variety of fibers and fabrics including two or more polymer components in a closed fiber spinning system and with a spin beam capable of delivering molten polymer streams of two or more different polymer components for fiber production within the closed system.

SUMMARY OF THE INVENTION

Therefore, in light of the above, and for other reasons that become apparent when the invention is fully described, an object of the present invention is to provide a closed fiber spinning system capable of producing a wide variety of single and multicomponent fibers and fabrics including different polymer components and having a desired denier and degree of uniformity.

Another object of the present invention is to provide a spin beam assembly for the closed system that is capable of delivering molten polymer streams to the spinneret of the closed system, where the molten polymer streams include at least two different polymer components having different melting temperatures.

A further object of the present invention is to uniformly maintain the two different polymer components at their substantially different melting temperatures within the spin beam assembly during delivery of the molten polymer streams to the spinneret.

Yet another object of the present invention is to provide a plurality of metering pumps to individually control the flow rate of different molten polymer fluid streams for extrusion at the spinneret.

The aforesaid objects are achieved individually and in combination, and it is not intended that the present invention be construed as requiring two or more of the objects to be combined unless expressly required by the claims attached hereto.

In accordance with the present invention, the aforementioned difficulties associated with forming fibers and fabrics having multiple polymer components in a closed system is overcome by employing a closed fiber spinning system including a spin beam assembly that is capable of supplying a plurality of molten polymer streams to a spinneret, where at least two of the polymer streams contain different polymer components, to form multicomponent fibers or fabrics including multiple polymer components that have a suitable uniformity and denier. The spin beam includes a plurality of metering pumps to independently control the flow rates of one or more polymer streams, as well as at least two thermal control units that independently and uniformly heat the different polymer components to their appropriate melting temperatures while maintaining thermal segregation between the different polymer components.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 1:
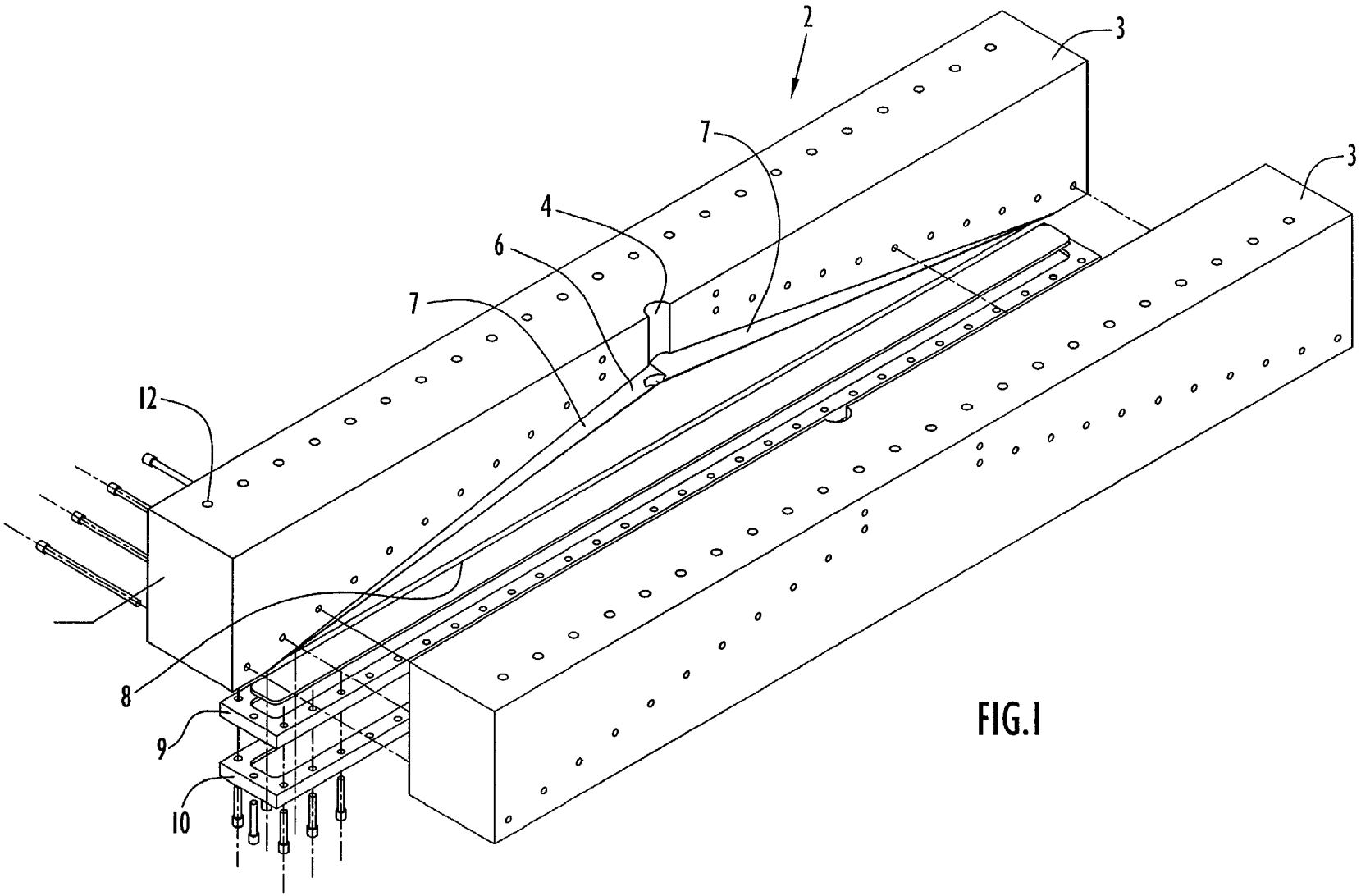
FIG. 1 is an exploded view in perspective of a conventional "coat hanger" spin beam for delivering molten polymer fluid to a spin pack in a closed system.

The closed fiber spinning system of the present invention is described below with reference to FIGS. 2 and 3. The terms "closed system" and "closed fiber spinning system", as used herein, refer to a fiber spinning system including an extrusion stage, a quenching stage and a drawing stage, where an air or other gas stream that is utilized to quench the fibers in the quenching stage is also utilized to draw and attenuate the fibers in the drawing stage, and the extrusion, quenching and drawing stages are performed in a common enclosed environment (e.g., a single chamber or a plurality of chambers communicating with each other). The term "fiber" as used herein includes both fibers of finite length, such as conventional staple fibers, as well as substantially continuous structures, such as filaments, unless otherwise indicated. The terms "bicomponent fiber" and "multicomponent fiber" refer to a fiber having at least two portions or segments, where at least one of the segments comprises one polymer component, and the remaining segments comprise another, different polymer component. The term "single component fiber" refers to a fiber consisting of a single polymer component. The term "mixed polymer fiber" refers to a fiber consisting of two or more different polymer components mixed together to form a substantially uniform composition of the polymer components within the formed fiber.

Fibers extruded in the closed system of the present invention can have virtually any transverse cross-sectional shape, including, but not limited to: round, elliptical, ribbon shaped, dog bone shaped, and multilobal cross-sectional shapes. The fibers may comprise any one or combination of melt spinnable resins, including, but not limited to: homopolymer, copolymers, terpolymers and blends thereof of: polyolefns, polyamides, polyesters, polyactic acid, nylon, poly(trimethylene terephthalate), and elastomeric polymers such as thermoplastic grade polyurethane. Suitable polyolefins include without limitation polymers such as polyethylene (e.g., polyethylene terephthalate, low density polyethylene, high density polyethylene, linear low density polyethylene), polypropylene (isotactic polypropylene, syndiotactic polypropylene, and blends of isotactic polypropylene and atactic polypropylene), poly-1-butene, poly-1-pentene, poly-1-hexene, poly-1-octene, polybutadiene, poly-1,7,-octadiene, and poly-1,4,-hexadiene, and the like, as well as copolymers, terpolymers and mixtures of thereof. In addition, the manufactured fibers may have any selected ratio of polymer components within the fibers.

Figure 2:
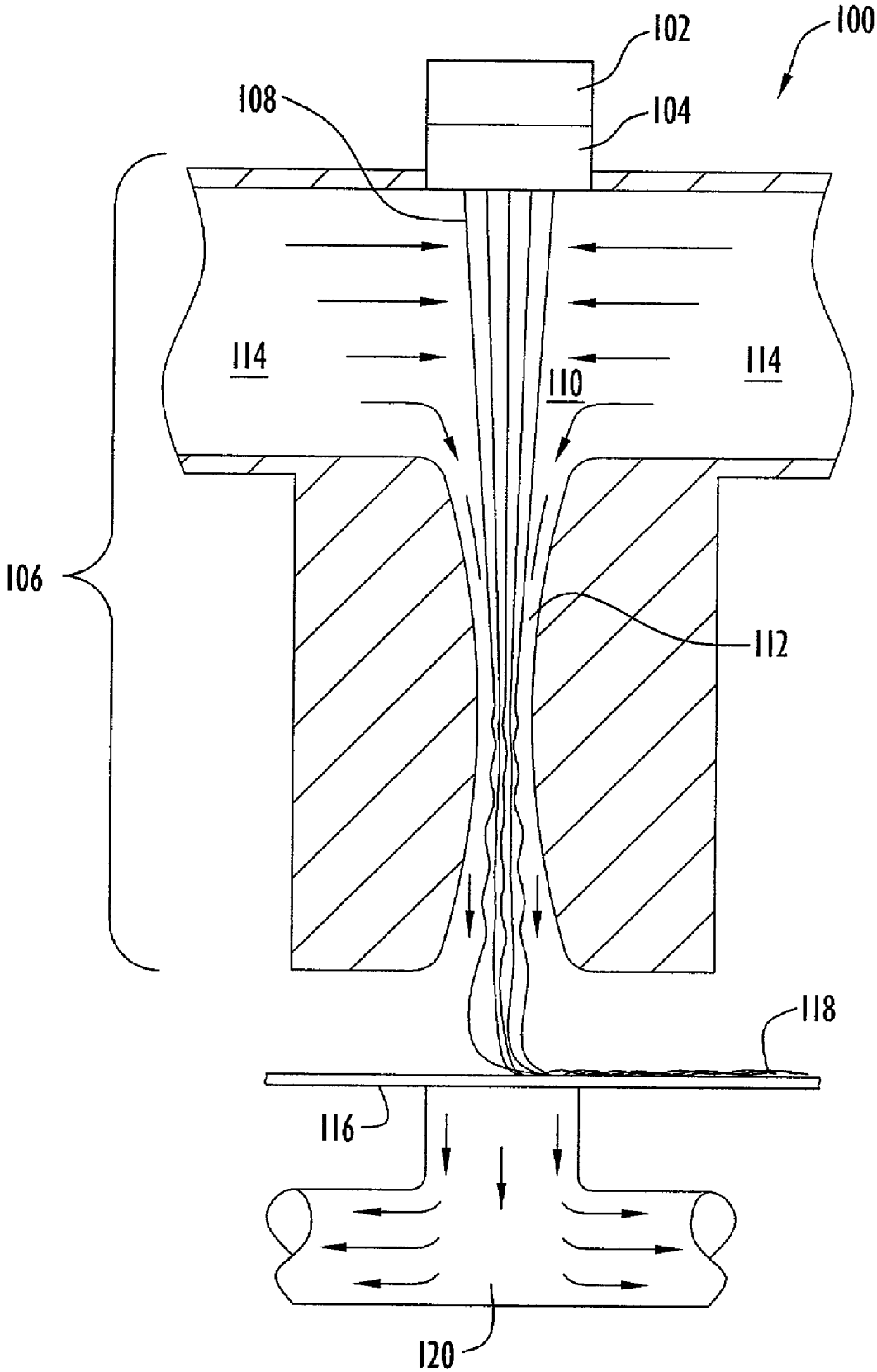
FIG. 2 is an elevational side view in partial section of an embodiment of the closed fiber spinning system of the present invention.

Referring to FIG. 2, a closed system 100 is depicted including a spin beam assembly 102 for delivering molten polymer streams to a spin pack 104, and an enclosed chamber 106 for forming and delivering extruded filaments 108 to a web-forming belt 116, thus forming an nonwoven web of fibers 118. It is to be noted that the closed chamber design depicted in FIG. 2 is provided for exemplary purposes only, and the present invention is in no way limited to such design. For example, any number of enclosed chamber designs may be utilized in practicing the present invention, including, without limitation, the enclosed chamber designs of U.S. Pat. Nos. 5,460,500, 5,503,784, 5,571,537, 5,766,646, 5,800,840, 5,814,349 and 5,820,888. The spin beam assembly, spin pack, enclosed chamber and belt are constructed of metal or any other suitable material to receive and process molten polymer fluid streams.

The spin beam assembly 102 provides a number of independently metered molten polymer streams to spin pack 104 for extrusion and fiber formation within closed system 100. Three separate and independent heating systems are provided in the spin beam assembly as described below to independently heat two segregated polymer fluid streams flowing into the spin beam assembly and the spin beam. Referring to FIG. 3, spin beam assembly 102 includes a generally rectangular and hollow frame 103 enclosing a pair of substantially cylindrical and hollow distribution manifolds 122, 130 and a generally rectangular spin beam 140. Each distribution manifold 122, 130 extends longitudinally along a rear wall 150 of the frame, with manifold 130 suspended slightly above and aligned substantially parallel with manifold 122. An inlet pipe 123 extends transversely from a central location of manifold 122 and through the rear wall 150 of frame 103 to connect with a polymer supply source (not shown). Similarly, another inlet pipe 131 extends transversely from a central location of manifold 130 and through an upper rear wall 151 of the frame to connect with another polymer supply source (not shown). A portion of each inlet pipe also extends within each manifold to connect with a polymer distribution pipe disposed within the manifold as described below. Manifold 122 is sealed at one end and connected to a heat medium supply conduit 124 at the other end, with conduit 124 extending through a side wall 152 of frame 103 and connecting to a heat medium supply source (not shown). Manifold 130 is also sealed at an end corresponding to the sealed end of manifold 122 and is connected at the other end to another heat medium supply conduit 132 extending through the side wall 152 of the frame, where the supply conduit 132 is also connected to a heat medium supply source (not shown). The manifolds are slightly staggered in alignment with respect to each other, with the end of manifold 122 that is connected to conduit 124 being closer to the side wall 152 of the frame than the corresponding end of manifold 130.

Disposed and extending longitudinally within each distribution manifold 122, 130 is a polymer distribution pipe that connects with the corresponding inlet pipe 123, 131 protruding into the manifold interior. Each manifold 122, 130 basically surrounds and jackets the distribution pipe disposed therein, allowing a fluidic heat transfer medium (e.g., Dowtherm) to be delivered by the respective supply conduit 124, 132 into the manifold so as to surround and transfer heat to polymer fluid disposed within the distribution pipe. The manifolds and piping associated with the manifolds facilitate independent and segregated heating of two different polymer components to different temperatures within spin beam assembly 102. Additionally, the manifold design provides uniform heating of polymer fluid flowing inside each polymer distribution pipe within each manifold by surrounding each distribution pipe with a heat medium at a substantially uniform temperature. This heating feature is a significant improvement over the electric heating design provided in the "coat hanger" style spin beam, because the electrical heaters in the "coat hanger" spin beam may yield undesirable thermal gradients within the spin beam sections.

Each distribution manifold 122, 130 further includes a set of six polymer transfer pipes 126, 134 extending transversely and at approximately equal longitudinally spaced locations from the manifold toward a front wall 153 of frame 103, where transfer pipes 126 (which extend from manifold 122) are substantially parallel with transfer pipes 134 (which extend from manifold 130). Each transfer pipe 126, 134 also extends into its respective manifold 122, 130 and connects at an appropriate location with the corresponding distribution pipe disposed therein. Due to the vertical offset between manifold 122 and manifold 130 within the frame of the spin beam assembly, transfer pipes 134 are immediately routed vertically downward toward manifold 122 upon emerging from manifold 130 so as to become substantially vertically aligned with transfer pipes 126 as they extend toward the front wall 153 of the frame. One skilled in the art will recognize that each distribution pipe and the transfer pipes connecting to each distribution pipe within each manifold can be independently designed to ensure a suitable residence time of polymer fluid traveling through the distribution pipe and being heated within the manifold. Further, the lengths of each of the transfer pipes extending from a particular distribution pipe are preferably equal to ensure the residence times of the fluid streams traveling within those transfer pipes is substantially the same.

Spin beam 140 is disposed longitudinally near the front wall 153 within frame 103. The spin beam houses a set of six generally rectangular pump blocks 142 longitudinally spaced along the spin beam to correspond with a single transfer pipe 126, 134 extending from each manifold 122, 130 toward the pump blocks. Each pump block 142 includes a first metering pump 128 that connects with a corresponding polymer transfer pipe 126 extending toward that pump block and a second metering pump 136 that connects with a corresponding polymer transfer pipe 134 extending toward that pump block. The transfer pipes 126, 134 extend through a rear wall of spin beam 140 to connect with their corresponding metering pumps 128, 136. A heat supply conduit 144 extends from a lower portion of the rear wall of the spin beam and through the frame side wall 152 to connect with a fluid heat transfer medium supply source (not shown). The spin beam is heated by heat transfer fluid medium supplied by conduit 144, which in turn heats and maintains pump blocks 142 and pumps 128, 136 at a suitable temperature during operation of the spin assembly. The pump blocks are further constructed of a material having a low thermal conductivity to control or limit the amount of heat transferred between the pump blocks, pumps and polymer fluid traveling through the pumps. For example, in fiber manufacturing processes where two different polymer components are utilized having different melting temperatures, the pump blocks are heated to the higher temperature melting point. However, the polymer component with the lower melting temperature will never achieve the higher temperature due to the limited heat transfer capacity of the pump block.

Each metering pump 128, 136 further includes an inlet for receiving polymer fluid from a corresponding polymer transfer pipe 126, 134 and multiple outlets for feeding polymer fluid streams at a selected flow rate to inlet channels in spin pack 104. In a preferred embodiment, each metering pump includes four outlets, such that the spin beam assembly is capable of providing two sets of twenty four polymer fluid streams, with the temperature and flow rate of each set being controlled independent of the other. Such an embodiment could, for example, provide metered polymer streams from each set about every six inches along a spin beam having a length of about twelve feet. However, it is noted that the metering pumps may include any number of suitable outlets depending upon the number of polymer streams required to be transferred to the spin pack.

Spin pack 104 includes a plurality of inlet channels for receiving polymer fluid streams from the spin beam assembly, a polymer filtration system, distribution systems and a spinneret with an array of spinning orifices for extruding polymer filaments therethrough. For example, the spinneret orifices may be arranged in a substantially horizontal, rectangular array, typically from 1000 to 5000 per meter of length of the spinneret. As used herein, the term "spinneret" refers to the lower most portion of the spin pack that delivers the molten polymer to and through orifices for extrusion into enclosed chamber 106. The spinneret can be implemented with holes drilled or etched through a plate or any other structure capable of issuing the required fiber streams. The spin pack basically coordinates molten polymer fluid flow from the spin beam to form a desired type of fiber (e.g., multicomponent fibers, fibers having a particular cross-sectional geometric configuration, etc.) as well as a desired number of fibers that are continuously extruded by the system. For example, the spin pack may include channels that combine two or more different polymer fluid streams fed from the spin beam prior to extrusion through the spinneret orifices. Additionally, the spinneret orifices may include a variety of different shapes (e.g., round, square, oval, keyhole shaped, etc.), resulting in varying types of resultant fiber cross-sectional geometries. An exemplary spin pack for use with system 100 is described in U.S. Pat. No. 5,162,074 to Hills, the disclosure of which is incorporated herein by reference in its entirety. However, it is noted that any conventional or other spin pack for spinning fibers may be utilized with system 100.

Enclosed chamber 106 includes a quenching station 110 disposed directly below spin pack 104 and a drawing station 112 disposed directly below the quenching station. A pair of conduits 114 are also connected at opposing surfaces of chamber 106 in the vicinity of quenching station 110. Each conduit 114 directs a stream of air (generally indicated by the arrows in FIG. 2) in a opposing direction from each other and toward extruded filaments 108 exiting spin pack 104 and traveling through quenching station 110. The extruded filaments are thus quenched by the converging air streams from conduits 114 at the quenching station. The air streams are preferably directed in a direction generally perpendicular to filaments 108 or slightly angled in a direction toward drawing station 112, which is disposed below the quenching station. However, it is noted that any number of air currents (e.g., a single air current) may be directed in any suitable orientation toward the extruded filaments disposed in the quenching station. It is further noted that any suitable gas other than air may be utilized to quench the filaments at the quenching station. Further, depending upon the types of polymer components utilized and the types of fibers to be formed, one or more controlled vapor or gas treatment streams may also be employed to chemically treat the extruded filaments within closed chamber 106 at quenching station 110 or at any other suitable location.

Chamber 106 preferably has a venturi profile at drawing station 112, where the chamber walls constrict to form a tapered or narrowed chamber section within the drawing station to facilitate an increased flow rate of the combined air streams passing therethrough. The increased flow rate of the air streams within the drawing station provides a suitable drawing force to stretch and attenuate the filaments. Drawing station 112 extends to an exit opening in chamber 106 that is separated a suitable laydown distance from web-forming belt 116.

Web-forming belt 116 is preferably a continuous screen belt through which air can pass, such as a Fourdrinier wire belt. Fibers exiting enclosed chamber 106 are laid down on the belt to form a nonwoven web. The belt is driven, e.g., by rollers or any other suitable drive mechanism, to deliver the web of fibers to one or more additional processing stations. Disposed beneath belt 116 and in line with the exit opening of chamber 106 is a recirculation chamber 120. The recirculation chamber includes a blower (not shown) that develops a negative pressure or suction within chamber 106 to direct the combined air streams from quenching station 110 through drawing station 112 and into the recirculation chamber (generally indicated by the arrows in FIG. 2). The air streams drawn into chamber 120 are recycled and delivered back to conduits 114 for redelivery into quenching station 110. Preferably, the recycled air streams are also directed through a heat exchanger and/or combined with fresh air so as to maintain a suitable temperature for the quenching air before being recirculated into quenching station 110. In an alternative embodiment, the closed system may not employ recycled air streams. Rather, a blower may continuously direct fresh air streams into and through enclosed chamber 106, with the air dissipating out of the closed system upon emerging from the drawing station rather than being recycled for further use.

Operation of closed system 100 is described below utilizing an exemplary bicomponent fiber spinning process, where polymer components A and B are fed to the spin beam assembly for forming the bicomponent fibers. It is to be noted, however, that system 100 may produce a wide variety of fibers, including single component and multicomponent fibers. A molten stream of polymer A is delivered to spin beam assembly 102 via inlet pipe 123, where it enters the polymer distribution pipe disposed within distribution manifold 122. Simultaneously, a molten stream of polymer B is delivered to the spin beam assembly via inlet pipe 131, where it enters the polymer distribution pipe disposed within distribution manifold 130. A fluid heat transfer medium, supplied by conduits 124, 132, is provided within both manifolds to surround the distribution pipes disposed therein and to uniformly and independently heat and/or maintain each of polymers A and B at a suitable temperature.

The polymer A stream travels through the distribution pipe in manifold 122 and enters polymer transfer pipes 126, which carry polymer A to the set of six metering pumps 128 disposed on pump blocks 142 in spin beam 140. Similarly, the polymer B stream travels through the distribution pipe in manifold 130 and enters polymer transfer pipes 134, which carry polymer B to the set of six metering pumps 136 disposed on the pump blocks in the spin beam. Metering pumps 128 establish a suitable flow rate for transferring a plurality of streams (e.g., twenty four) of polymer A to correspondingly aligned inlet channels disposed on spin pack 104, while metering pumps 136 establish a suitable flow rate (which is independent of the flow rate established for the polymer A streams) for transferring a plurality of streams of polymer B to correspondingly aligned inlet channels disposed on the spin pack.

The independently metered sets of molten polymer A and B streams are directed through channels in spin pack 104 and through the spinneret to form bicomponent polymer fibers consisting of those two polymers. The type of bicomponent fiber formed (e.g., side-by-side, sheath/core, "islands in the sea", etc.) is established by the spin pack design, where separated streams of polymers A and B are combined in a suitable manner upon emerging from the spinneret. Additionally, a suitable cross-sectional geometry for the extruded filaments may also be established by, e.g., providing spinneret orifices of one or more selected geometries.

Filaments 108 consisting of polymers A and B are extruded through the spinneret and enter quenching station 110 of enclosed chamber 106, where the filaments are exposed to quenching air streams directed at the filaments from conduits 114. The blower in recirculation chamber 120 creates a suction within the enclosed chamber that directs the air streams through quenching station 110 and into drawing station 112, where the velocity of the air streams is increased due to the constricted profile within a portion of the drawing station. The extruded filaments are also directed downward with the air streams from the quenching station into the drawing station, at which point the filaments are drawn and attenuated in the drawing station. The drawn fibers continue through enclosed chamber 106 to exit and form a nonwoven web 118 of fibers on belt 116. The web of fibers are carried away by belt 116 for further processing. Air streams traveling through and exiting enclosed chamber 120 are drawn into recirculating chamber 120, where the streams are ultimately directed back into conduits 114 and toward quenching station 110.

The combined features of temperature segregation and independent delivery of multiple metered streams of molten polymer fluids within the spin beam in the closed system of the present invention facilitates the production of a widely diverse range of fibers and fabrics not previously achieved or even considered in conventional closed systems. For example, providing independent and substantially uniform temperature control within different molten polymer streams in the spin beam vastly increases the number of different polymer combinations and ratios that can be achieved in individual fibers during fiber formation. An even spinneret temperature profile may be maintained in the system without forcing temperature changes in the polymer streams, which is not practical in the electrically heated, "coat hanger" spin beam. The uniform temperature control provided by the spin beam of the present invention, which eliminates potential thermal gradients during heating, is far superior to the electrically heated, "coat hanger" spin beams typically utilized in closed systems.

The independent control of different polymer component supply pressures via the separated sets of metering pumps offers greater flexibility of polymer selection and distribution for any given machine configuration by providing enhanced control for even delivery of polymer over the entire machine width. The residence time can be more precisely controlled with the spin beam assembly and spin pack of the present invention as compared to the "coat hanger" system, a particularly important feature for heat sensitive polymers requiring a reduced residence time. In particular, short residence times may be established in the closed system of the present invention to minimize heat transfer between polymer streams and the spin beam assembly and spin pack equipment.

The improved draw uniformity and prevention of external air flow or temperature disturbances that a closed system provides further enhances the string-up and production of certain types of sensitive multicomponent fibers. Additionally, the closed system facilitates the spinning of certain multicomponent fibers into a controlled vapor or gas atmosphere for chemical treatment of filaments formed during spinning, while easily containing the vapors in the closed system. The spin beam assembly and spin pack also increases the spinneret orifice density and possible orifice configurations in comparison to the "coat hanger" spin beam (which only produces a linear or narrow array of extruded filaments from the spinneret) to increase productivity and multiple polymer component products manufactured in a single closed system. Further, the multi-stream metering spin beam combined with the closed system of the present invention facilitates the production of high value fabrics including, but not limited to, anti-stat fabrics, skin wellness fabrics, wettability and abrasion resistance fabrics, and fabrics formed by differential bonding methods (rather than conventionally used heat embossing). Multiple fabric products may also be continuously produced by a single closed system of the invention by, e.g., varying the types and grouping of fibers being extruded in the cross machine direction of the system.

Figure 4:
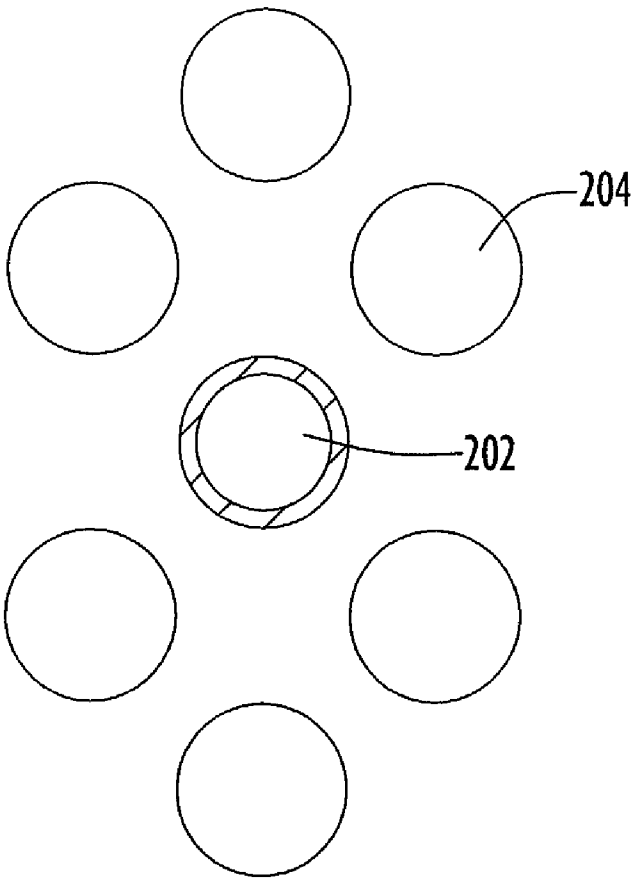

Some examples of polymer fibers that can be produced according to the present invention are illustrated in FIGS. 4–8. FIG. 4 depicts a single, low percent sheath/core fiber 202 formed among a group of single component or homopolymer fibers 204 to introduce a high value, low melt strength, temperature and residence time sensitive additive into a high quality web formed by the fibers.

Figure 5:
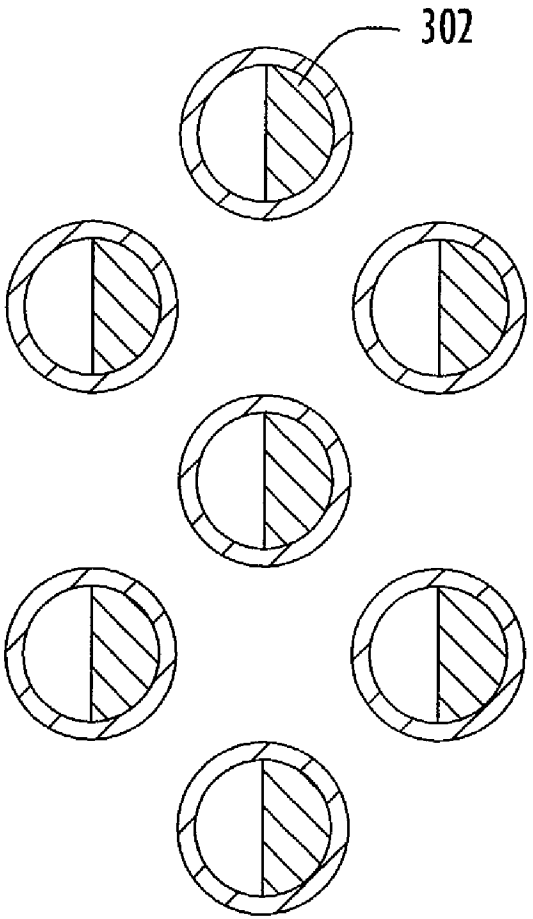
FIGS. 4–8 are transverse cross-sectional views illustrating embodiments of different groups of fibers that may be produced by a closed system of the present invention.
Figure 6B:
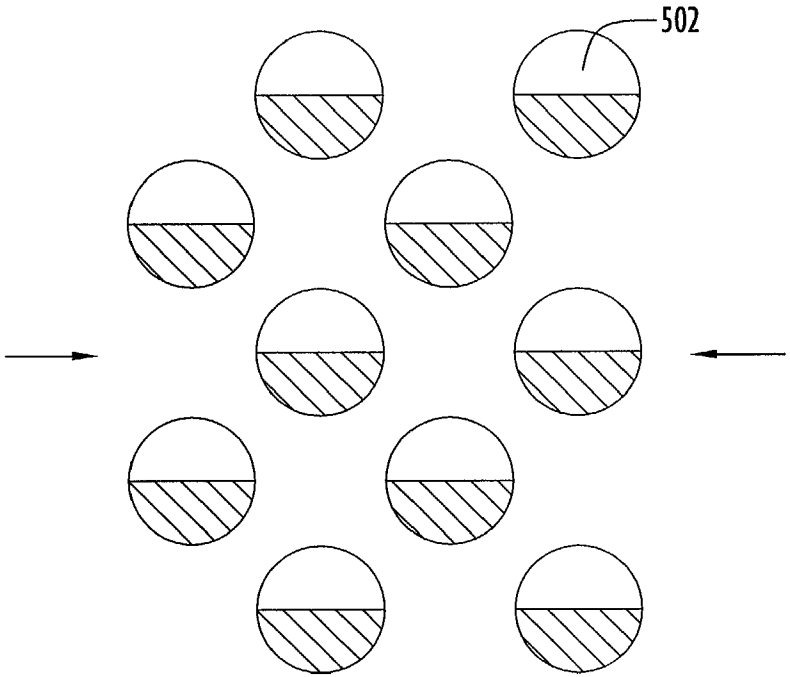
Figure 6A:
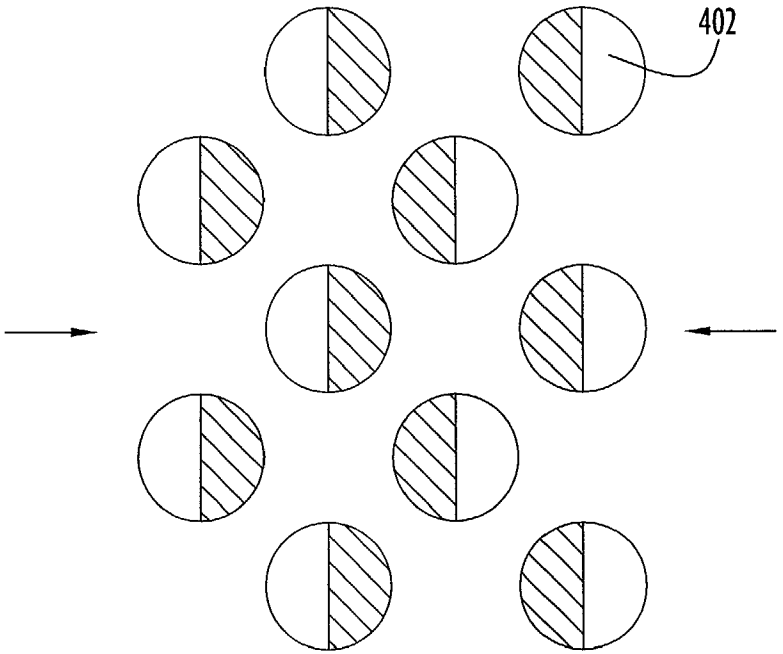
Figure 8:
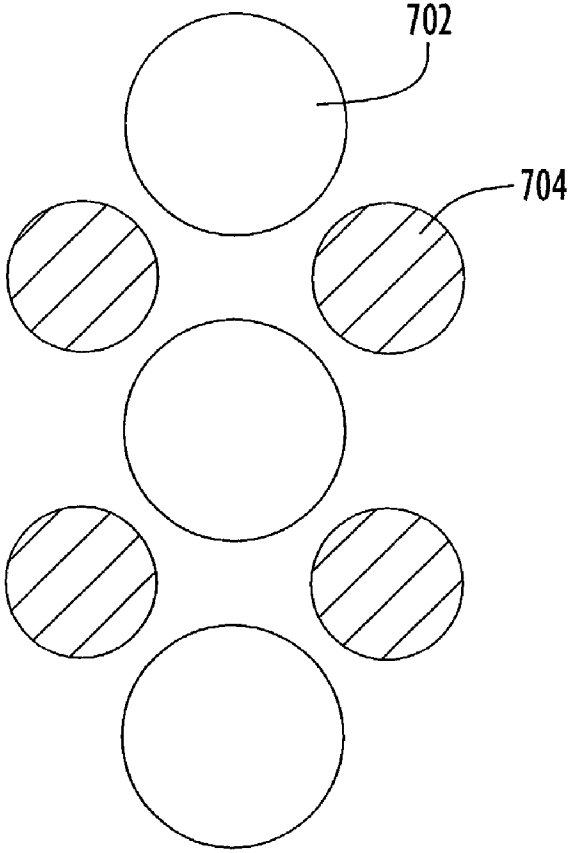
Figure 7:
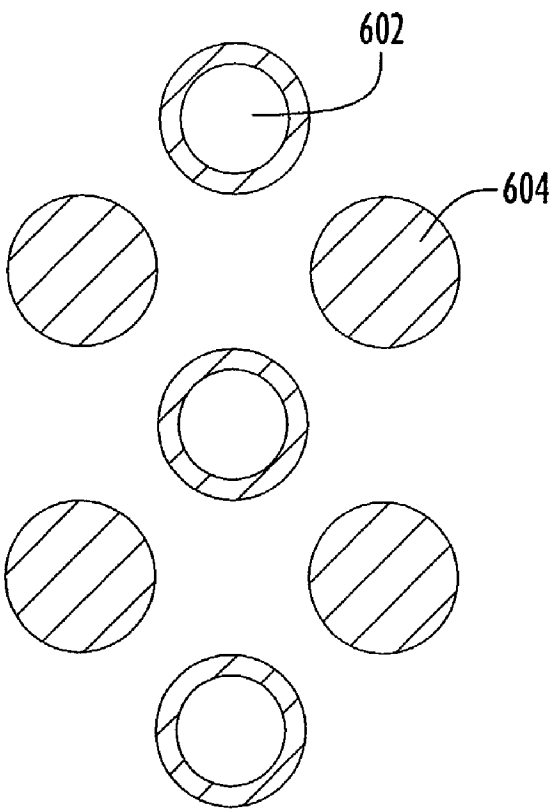

FIG. 5 depicts a group of tri-component sheathed side-by-side fibers 302. These fibers exhibit both of the side-by-side and sheath/core benefits in one web formed by the fibers with the system of the present invention. In certain quench sensitive polymer combinations, or in combinations where a viscosity mismatch exists between polymer components, the spin pack of system may be configured to deliver formed fibers for optimal orientation relative to the quenching air to minimize negative effects associated with bending or dog-legging of extruded filaments from the spinneret and thus increase processing hole density and overall productivity. FIGS. 6*a* and 6*b* depict two different arrangements of side-by-side bicomponent fiber configurations, where the fibers 402, 502 of each configuration are oriented differently with respect to a dual air quench system (direction of quenching air in FIGS. 6*a* and 6*b* is depicted by arrows). FIG. 7 depicts yet another grouping of fibers that may be produced by the system of the present invention, where dedicated metering techniques are utilized for producing bicomponent sheath/core fibers 602 mixed with single component fibers 604. In still another embodiment, the spin beam and spin pack of the present invention may be designed to deliver exact mixed fiber sizes through multi-stream dedicated metering so as to produce fabrics with tailored pore-size gradients. FIG. 8 depicts a grouping of fibers that would produce such as a fabric, where larger diameter fibers 702 are combined with smaller diameter fibers 704 during the closed system fiber spinning process.

Other examples of fibers that may be formed utilizing the system of the present invention are sheath/core fibers where the sheath is a thermoplastic material with a low melting point and the core material is a thermoplastic material with high strength characteristics. A spunbond web of these fibers can be bonded thermally (e.g., using calendar rolls, through-air, etc.) at temperatures high enough to soften or melt the outer sheath material but low enough so as not to compromise the strength characteristics of the core material. Such fibers can also have special properties available in the sheath such as soft hand, anti-microbial capabilities, and gamma stability. Splittable fibers can also be formed in which two or more separate polymer components in extruded filaments are separated after formation of a web thus creating a web of finer fibers. Additionally, side-by-side fibers can be formed that spontaneously crimp and bulk when subjected to appropriate treatment. Mixed polymer fibers may also be formed in the closed system of the present invention to provide a number of useful properties for final products manufactured utilizing those fibers.

From the foregoing examples, it can be seen that the closed system of the present invention is extremely versatile and facilitates the production of a wide variety of multiple polymer component fiber and fabric combinations in a single system.

The present invention is not limited to the particular embodiments described above, and additional or modified processing techniques are considered to be within the scope of the invention. As previously noted, the present invention is not limited to the closed chamber configuration of FIG. 2; rather, the closed system of the present invention may utilize any closed environment configuration that prevents exposure of the extruded filaments to uncontrolled temperatures and air currents during fiber formation.

Figure 3:
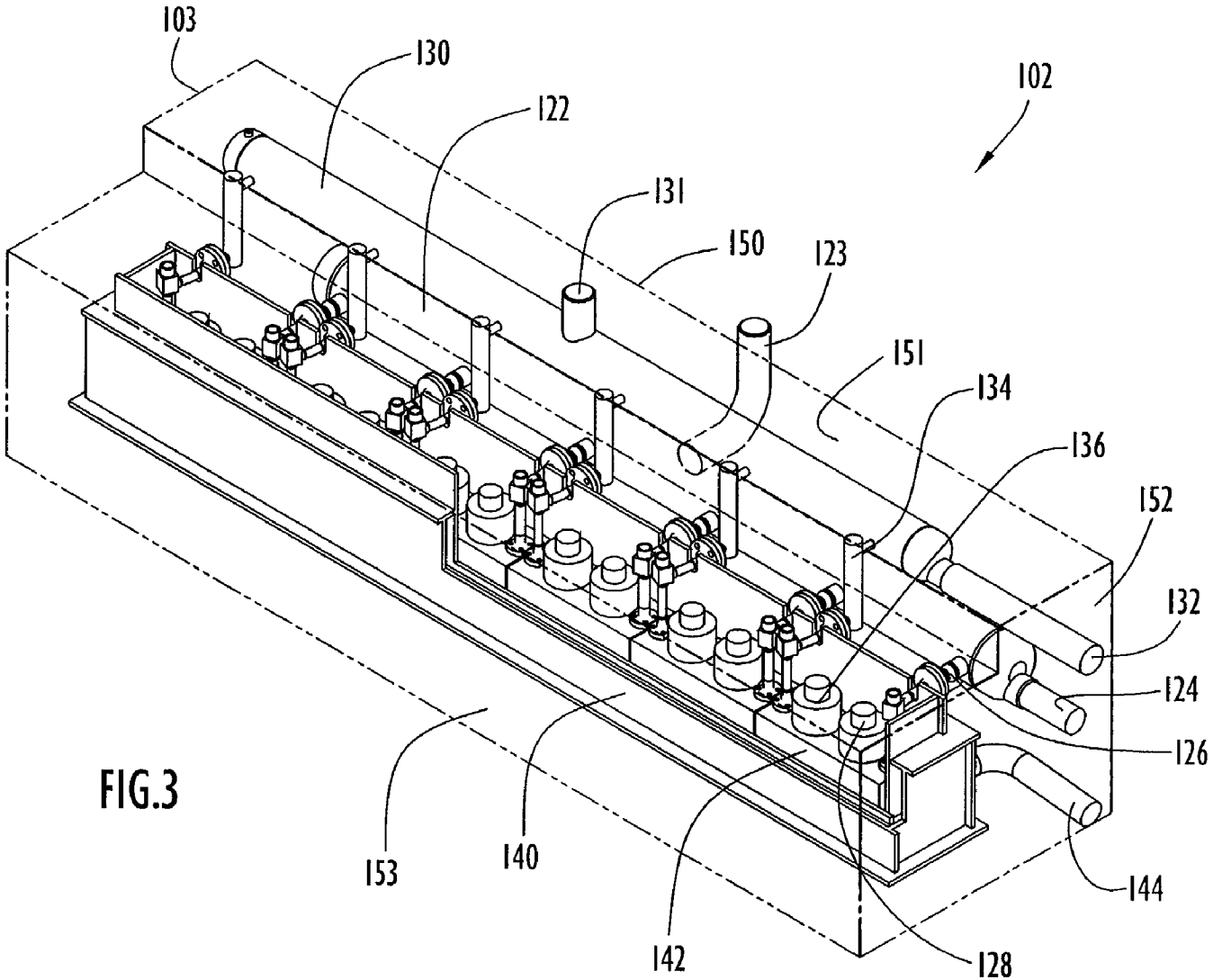
FIG. 3 is a perspective view in partial section of an embodiment of the spin beam assembly for the closed system of FIG. 1.

Similarly, the spin beam assembly is not limited to the configuration of FIG. 3; rather, the spin beam assembly may be designed to receive and thermally process and meter any number of segregated polymer fluid supply streams. In other words, the spin beam assembly may include any suitable number of polymer supply inlets connecting to any suitable number of distribution pipes within distribution manifolds to independently heat and/or maintain any number of different polymer streams at a variety of different temperatures. The spin beam assembly may further include any suitable number of metering pumps, where each pump has any suitable number of outlet streams, to independently provide different polymer fluid streams at varying flow rates to the spin pack. Further, each of the metering pumps may be configured to deliver one or more polymer fluid streams to the spin pack at a flow rate independent of the flow rates for streams metered by any of the other metering pumps.

The spin pack may be designed in any suitable manner to facilitate the production of fibers and fabrics including any combination of single component or multicomponent fibers of any suitable cross-sectional geometries. Further, any number or combination of fiber processing techniques, yarn forming techniques, and woven and non-woven fabric formation processes can be applied to the fibers formed in accordance with the present invention.

Having described preferred embodiments of a new and improved closed system for producing fibers and fabrics having multiple polymer components, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. In a system for manufacturing fibers including a spin beam assembly, and a quenching chamber in communication with a drawing chamber, wherein the system maintains an enclosed environment between the spin beam assembly, the quenching chamber and the drawing chamber to prevent uncontrolled gas currents from entering the enclosed environment, a method of forming a non-woven web of fibers comprising:

(a) delivering a plurality of polymer streams from the spin beam assembly to spinneret orifices, wherein at least two of the polymer streams include differing polymer components, and the differing polymer components are segregated and are independently maintained at different temperatures within the spin beam assembly by providing a plurality of manifold sections within the spin beam assembly, each manifold section including a distribution pipe configured to transfer a respective polymer component to a plurality of piping sections extending within the manifold section and a heat transfer medium that flows within the manifold section and around the piping sections extending into the manifold section so as to maintain the respective polymer component at a selected temperature;

(b) extruding the plurality of polymer streams through the spinneret orifices to form a plurality of filaments;

(c) quenching the extruded filaments by contacting the filaments with a gas stream in the quenching chamber;

(d) drawing the quenched filaments in the drawing chamber; and (e) depositing the drawn filaments onto a forming surface to form a non-woven fibrous web on the forming surface.

2. The method of claim 1, wherein step (a) includes:

(a.1) delivering segregated polymer streams at varying flow rates to the spinneret orifices.

3. The method of claim 1, further comprising:

(f) forming an array of multicomponent fibers.

4. The method of claim 1, further comprising:

(f) forming an array of bicomponent fibers.

5. The method of claim 1, further comprising:

(f) forming an array of single component fibers, wherein at least one single component fiber consists of a polymer component that is different from a polymer component of at least one other single component fiber.

6. The method of claim 1, wherein the delivery of a plurality of polymer streams from the spin beam assembly to spinneret orifices further includes providing a plurality of pump blocks within the spin beam assembly and a plurality of pumps disposed on the pump blocks, wherein the pump blocks are configured to limit heat transfer from each pump block to polymer components flowing within each pump block.

7. The method of claim 1, wherein the delivery of a plurality of polymer streams from the spin beam assembly to spinneret orifices further includes providing a plurality of pump blocks within the spin beam assembly and a plurality of pumps disposed on the pump blocks, wherein the pump blocks are disposed such that each pump block is adjacent at least one other pump block, and the pump blocks are configured to limit heat transfer between adjacent pump blocks.

* * * * *